US005797803A

United States Patent [19]

Jung

[11] Patent Number: 5,797,803

[45] Date of Patent: Aug. 25, 1998

[54] WRIST FIXING BAND FOR GOLF

[76] Inventor: Chul Hi Jung, #209-1001 Kyungnam APT, 38 Juyup-dong, Koyang-Si, Kyunggi-do, Rep. of Korea

[21] Appl. No.: 858,688

[22] Filed: May 19, 1997

[30] Foreign Application Priority Data

Jan. 7, 1997 [KR] Rep. of Korea ..... 97-138

[51] Int. Cl.[6] ..... A63B 69/36

[52] U.S. Cl. ..... 473/213; 602/21; 473/62

[58] Field of Search ..... 473/212, 213, 473/214, 276, 62; 602/21

[56] References Cited

U.S. PATENT DOCUMENTS

| | | | |
|---|---|---|---|
| 3,235,258 | 2/1966 | Stroburg | 473/213 |
| 4,023,812 | 5/1977 | Lorang . | |
| 4,057,255 | 11/1977 | Bishop . | |
| 4,273,336 | 6/1981 | Larkey . | |
| 5,199,712 | 4/1993 | Hoyle, Jr. et al. . | |
| 5,207,430 | 5/1993 | Goins | 473/213 |
| 5,316,306 | 5/1994 | Cody . | |

*Primary Examiner*—George J. Marlo
*Attorney, Agent, or Firm*—Oblon, Spivak, McClelland, Maier & Neustadt, P.C.

[57] ABSTRACT

Disclosed is a wrist fixing band for golf capable of preventing a wrist of a golfer bending toward the back of a hand of the golfer during the swing action which has a simple structure and a low manufacturing cost. In the wrist fixing band for golf according to the present invention, a prop of the back of an arm is formed as a shape capable of supporting the back of the golfer's arm. A prop of the back of the hand is formed as a shape capable of supporting the back of the golfer's hand. The prop of the back of the arm and the prop of the back of the hand is engaged with each other by a center pin. The bending angles of the prop of the back of the arm and the prop of the back of the hand are controlled by the center pin. The bending angle between the prop of the back of the arm and the center pin can be freely changed. A relative bending angle between the prop of the back of the arm and the prop of the back of the hand can be controlled by the bending angle between the prop of the back of the arm and the center pin. The prop of the back of the hand can be moved in the direction of golfer's thumb and forefinger centering around the center pin.

4 Claims, 5 Drawing Sheets

WRIST FIXING BAND FOR GOLF

BACKGROUND OF THE INVENTION

1. Field of the Invention

The present invention relates to a wrist of a golfer bending for golf, and more particularly to a wrist fixing band for golf capable of preventing a wrist of a golfer bending toward the back of a hand of the golfer during the swing action which has a simple structure and a low manufacturing cost.

2. Description of the Prior Art

As a result of ceaseless technique's development from the past, present civilization brought a remarkable development of each field. As such result, not only in a general industry field but also in a sport field many instruments are developed and new theories are instructed. Out of them, a variety of instruments for the golf practice have been proposed hitherto. More particularly, wrist fixing bands for improving a golfer's skill in a short time have been developed.

Method for playing golf better is dream and reality of all golfers. As other individual game such as shooting, Western-style archery, etc., the skill's improvement namely method capable of reducing some mistakes is various. Through all explanation for such variety is difficult, it is not worth mentioning as explaining too much in professional books or by much experience that particular for part about the wrist, namely for the wrist's role or use, is important. In other words, as explaining not only by experience or in the professional books but also in a golf theory, in the midst of swing the wrist use's mistake is perceived as the most important element out of mistakes in swing.

In case that in the midst of swing the golfer's wrist is bent towards the palm or the back of the hand, not being fixed at a regular angle against the palm or the back of the hand, the above wrist's mistake is why a club head's direction is at the beck and call of a golf ball, thereby an extravagant slice or hook are caused, and a considerable influence is also caused in proportional distance. In the whole swing course accordingly, to bend the wrist towards the back of the hand or the palm is perceived as the most important one out of mistakes to be abstained not only in an amateur field but also in even professional golf field. Also in the swing action the top's position, namely the position the club is not turned any more by back-swing, is a position that the back-swing finishes, a down-swing and an impact follow subsequently. Therefore, a preferable top's position is perceived as an important particular for impacting the golf ball with a proper battling force and for landing it to at hoping place.

An example of a golf's wrist fixing band for fixing the wrist against the back and the palm of the hand during the swing action is disclosed in Korean Patent Application No. 96-14610 which is filed by the same applicant as the present invention. However, in the above Korean Patent Application, the instrument for controlling a bending angle between the prop of the back of the arm and the prop of the back of the hand, and the device for allowing the prop of the back of the hand for moving toward the thumb and the little finger of the golfer are separated from each other. Therefore, the total construction of the wrist fixing band for golf is completed.

SUMMARY OF THE INVENTION

The present invention is contrived to solve the foregoing problems. It is an object of the present invention to provide a wrist fixing band for golf capable of preventing a wrist of a golfer bending toward the back of a hand of the golfer during the swing action which has a simple structure and a low manufacturing cost.

In order to achieve the above first object, the present invention provides a wrist fixing band for golf comprising:

a prop of the back of an arm being formed as a shape capable of supporting the back of the arm, the prop of the back of the arm including a first center pin hole which is formed through a front end of the prop of the back of the arm, the prop of the back of the arm including a guide protrusion protruding from an outer surface of the prop of the back of the arm, and the prop of the back of the arm including a first sliding groove which is formed through a lower portion of the prop of the back of the arm;

a prop of the back of the hand formed as a shape capable of supporting the back of the hand, the prop of the back of the hand including a spacer protruding from an outer surface of the prop of the back of the hand at a rear end thereof, the prop of the back of the hand including a second center pin hole which is formed through a center of the spacer, in which an upper portion of the spacer is inserted into the first sliding groove;

a bending angle control knob being formed as a circular plate shape having a predetermined thickness, the bending angle control knob including a second sliding groove for receiving the guide protrusion, the bending angle control knob including a second center pin hole which is formed through a center of the bending angle control knob, in which the second sliding groove is formed at a bottom side of the bending angle control knob, and the guide protrusion is inserted into the second sliding groove;

a center pin for fixing the prop of the back of the arm, the prop of the back of the hand and the bending angle control knob together, the center pin being inserted into the first, second and third center pin hole in sequence, the center pin having a head portion at its front end and a fixing portion at its rear end; and a fixing means for fixing the prop of the back of the arm to an arm of the golfer.

In the wrist fixing band for golf as described above, a relative bending angle of the prop of the back of the arm and the prop of the back of the hand is controlled by controlling a slant direction of the center pin in accordance with the rotation of the bending angle control knob.

As described above, in the wrist fixing band for golf according to the present invention, the prop of the back of the arm supports the arm of the golfer and the prop of the back of the hand supports the hand of the golfer during the swing action. In other words, when the golfer swings a golf club under the state that the golfer puts on the wrist fixing band for golf, the prop of the back of the hand cannot bent toward the prop of the back of the arm by the operation of the center pin. Accordingly, the wrist of the golfer is not bent toward the back of the hand during the swing action.

Further, the relative bending angle of the prop of the back of the arm and the prop of the back of the hand is controlled by controlling an angle between the center pin and the prop of the back of the arm. Therefore, the golfer controls the bending angle of the wrist of the golfer according to the golfer's preference. In addition, although the bending angle of the prop of the back of the arm and the prop of the back of the hand is maintained, the wrist fixing band for golf can move toward the thumb and the little finger of the golfer. As a result, the so-called cocking of the wrist can be performed.

BRIEF DESCRIPTION OF THE DRAWINGS

The above object and other characteristics and advantages of the present invention will become more apparent by describing in detail a preferred embodiment thereof with reference to the attached drawings, in which.

DETAILED DESCRIPTION OF THE INVENTION

Hereinafter, the preferred embodiments of the present invention will be explained in more detail with reference to the accompanying drawings.

Figure 1:
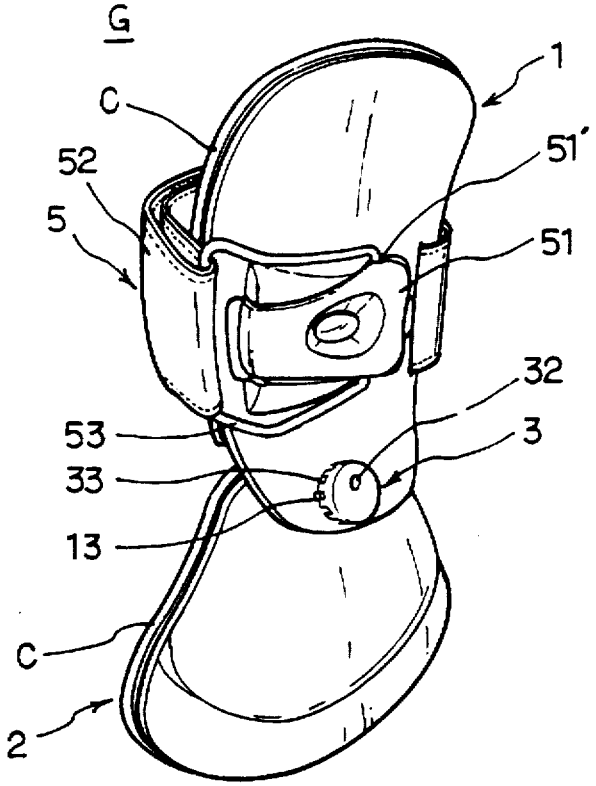
FIG. 1 is a perspective view of a wrist fixing band for golf according to the present invention.
Figure 2:
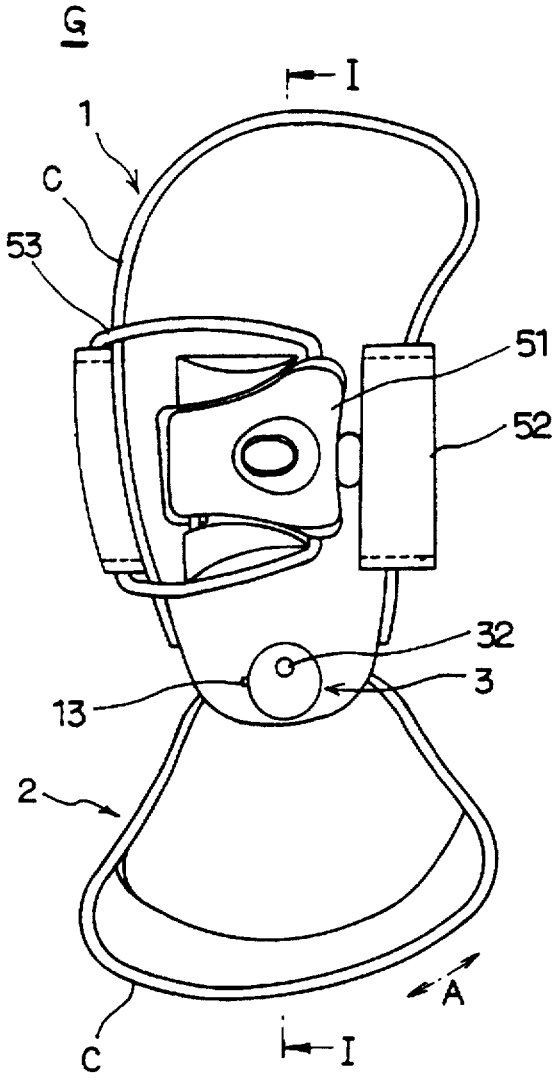
FIG. 2 is a front view of the wrist fixing band according to the present invention.

In the first embodiment, FIG. 1 is a perspective view of a wrist fixing band for golf according to the present invention and FIG. 2 is a front view of a wrist fixing band for golf according to the present invention.

The wrist fixing band for golf according to the present invention includes a prop of the back of the arm 1. The prop of the back of the arm 1 is molded as a shape capable of shielding the back of the arm near to a wrist. A central pin hole 11 is formed through a front end of the prop of the back of the arm 1. A guide protrusion 12 protrudes from an outer surface of the prop of the back of the arm 1. A stop protrusion 13 is formed at a proper position outside the guide protrusion 12. A sliding groove 14 having a semicircleshape is formed at a lower portion of the central pin hole 11. A metal piece 15 having a pin hole 15' is fixed to an upper side of central pin hole 11. The pin hole 15' corresponds to the central pin hole 11.

The wrist fixing band for golf according to the present invention includes a prop of the back of the hand 2. The prop of the back of the hand 2 has a shape capable of shielding the back of the hand of a golfer. A spacer 21 protrudes from an outer surface of the prop of the back of the hand 2 at a rear end thereof. An upper end side of the spacer 21 is formed as a sliding surface 22 corresponding to the sliding groove 14. A center pin hole 23 is formed through a center of the spacer 21. The sliding surface 22 of the spacer 21 is inserted into the sliding groove 14 which is formed at a bottom portion of the prop of the back of the hand 2.

By forming the spacer 21 on the prop of the back of the hand 2, the given interval is kept between the bottom side of the prop of the back of the arm 1 and the outer surface of the prop of the back of the hand 2. Such interval keeping is so that the bottom side of the prop of the back of the arm 1 and the outer surface of the prop of the back of the hand 2 cannot interfere each other, when the prop of the back of the hand 2 is assembled towards the outer surface or the bottom side of the prop of the back of the arm 1.

The wrist fixing band for golf according to the present invention includes a bending angle control knob 3 capable of controlling a relative bending angle between the prop of the back of the arm 1 and the prop of the back of the hand 2. The bending angle control knob 3 is formed as a circular plate shape having a predetermined thickness, and includes a sliding groove 31 for receiving the guide protrusion 12 of the prop of the back of the arm 1. The bending angle control knob 3 includes a center pin hole 32 which is formed through a center of the bending angle control knob 3. The sliding groove 31 is formed at a bottom side of the bending angle control knob 3. The guide protrusion 12 can be inserted into the sliding groove 31.

A plurality of locking grooves 33 are formed at an outer periphery of a bottom side of the bending angle control knob 3. A magnetic 34 is fixed to an inner side of the locking grooves 33. Under the state that the guide protrusion 12 of the prop of the back of the arm 1 is inserted into the sliding groove 31, a stop protrusion 13 protruding from an outer surface of the prop of the back of the arm 1 can be inserted into the locking grooves 33. The metal piece 15 is fixed to the outer surface of the prop of the back of the arm 1 and can be engaged with the magnetic 34.

The wrist fixing band for golf according to the present invention includes a center pin 4 for fixing the prop of the back of the arm 1, the prop of the back of the hand 2 and the bending angle control knob 3 together. The center pin 4 is inserted into the center pin holes 11, 23 and 32 in sequence. The center pin 4 has a head portion 41 at its front end and a fixing portion 42 at its rear end. The head portion 41 and the fixing portion 42 fix the center pin 4 in the center pin holes 11, 23 and 32. The center pin has a predetermined length so that the stop protrusion 13 can be released from the locking grooves 33 of the bending angle control knob 3. The bending angle control knob 3 can rotate under the state that the bending angle control knob 3 is pulled upwards.

Under thus combining state of the center pin 4, since a diameter of the pin hole 23 of the prop of the back of the hand 2 is grater than a diameter of the center pin 4, the center pin 4 can smoothly pass through the center pin hole 11 of the back of the arm 1 and the center pin hole 23 of the back of the hand 2. Under the state that the center pin hole 11 of the prop of the back of the arm 1 is eccentric with the center pin hole 23 of the prop of the back of the hand 2, the center pin 4 is slant with a plan established by the prop of the back of the arm 1 in a certain angle.

Figure 3:
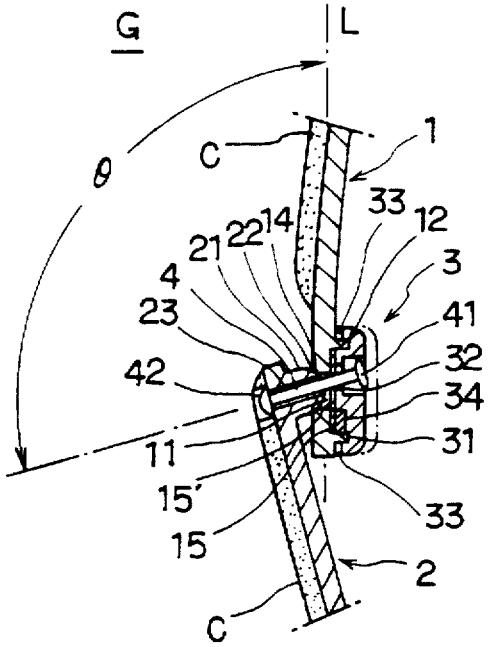
FIGS. 3 illustrates a state that a golfer puts on the wrist fixing band according to the present invention.
Figure 4:
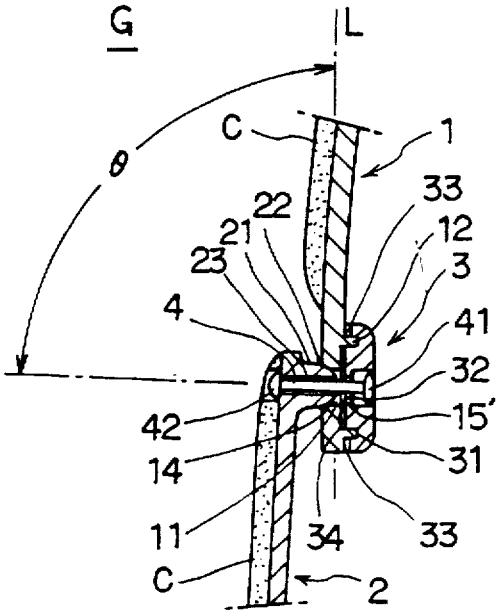
FIGS. 4 and 5 respectively are enlarged sectional views taken along line I—I illustrated in FIG. 2, showing a preferred first embodiment according to the present invention; and the first embodiment attached to a golfer

Accordingly, as shown in FIG. 3, an angle θ established by a segment line L of the prop of the back of the arm 1 and the center pin 4 at the time that the bending angle control knob 3 rotates is maximized, the prop of the back of the hand 2 is bent toward the outer surface of the prop of the back of the arm 1. As shown in FIG. 4, the angle θ established by a segment line L of the prop of the back of the arm 1 and the center pin 4 at the time that the bending angle control knob 3 rotates is minimized, the prop of the back of the hand 2 is bent toward the bottom side of the prop of the back of the arm 1. When a certain angle is given between the prop of the back of the arm 1 and the prop of the back of the hand 2, the prop of the back of the hand 2 is bent toward the thumb and the little finger of the golfer centering around the center pin 4.

The wrist fixing band for golf according to the present invention includes a fixing member 5 for fixing the prop of the back of the arm 1 to an arm of the golfer. An end of a clamp 51 is fixed to a one side of the prop of the back of the arm 1. A locking groove 51' is formed the other side of the clamp 51. An end of a fixing band 52 is fixed to the side of the prop of the back of the arm 1 opposite to the side thereof to which the clamp 51 is fixed. A hook 53 is engaged with a side of the fixing band 52. The hook 53 is inserted into the locking groove 51' of the clamp 52.

Figure 5:
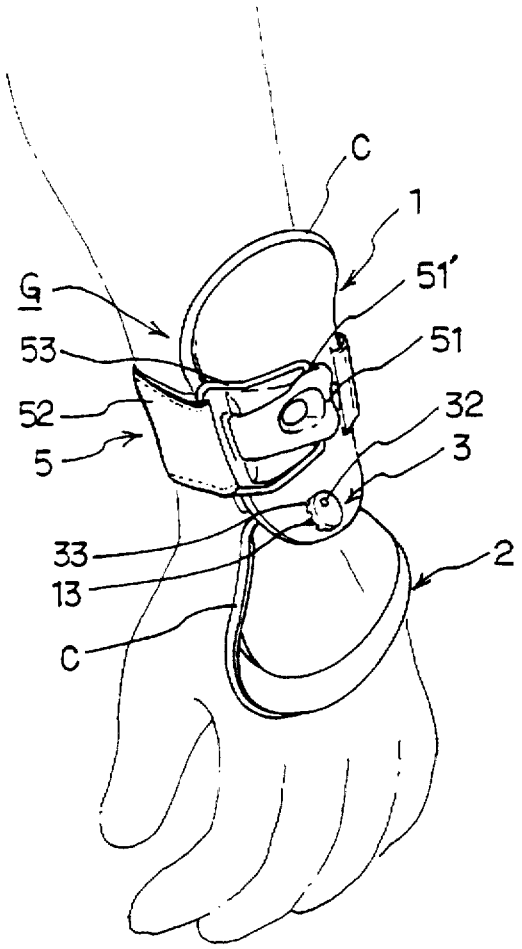

As shown in FIG. 5, in the wrist fixing band G for golf according to the present invention, by fixing the prop of the back of the arm 1 and the prop of the back of the hand 2 respectively on the golfer's arm back side and on the golfer's hand back side, and by winding the fixing band 52 on the arm in order to insert the hook 53 into the locking groove 51' of the clamp 51, the clamp 51 is brought into contact with the surface of the prop of the back of the arm 1.

If a golfer puts on the wrist fixing band G for golf as described above, the back of the arm of the golfer is supported by the side of the prop of the back of the arm 2, and the back of the hand of the golfer is supported by the side of the prop of the back of the hand 2. Thereby, it is possible to prevent the wrist of the golfer from bending toward the prop of the back of the hand 2 during the swing action. Under the state that the bending angle control knob 3 is pulled upwards and the angle θ established between the center pin 4 and the prop of the back of the arm 1 is controlled, a relative bending angle between the prop of the back of the arm 1 and the prop of the back of the hand 2 can be controlled. The golfer can control the bending angle of the wrist of the golfer according to the golfer's preference during the swing action.

Once controlled relative bending angle of the prop of the back of the hand 2 and the prop of the back of the arm 1, removed the pulling force of the bending angle control knob 3, the stop protrusion 13 of the prop of the back of the arm 1 is inserted into the locking grooves 33 of the bending angle control knob 3 by the magnetic force of the magnetic 34 fixed to the side of the bending angle control knob 3. Thereby, the movement of the bending angle control knob 3 is prevented during the swing action, and the bending angle between the prop of the back of the arm 1 and the prop of the back of the hand 2 is not changed. Even if the bending angle between the prop of the back of the arm 1 and the prop of the back of the hand 2 is maintained, the prop of the back of the hand 2 can be got movable in the direction of the thumb and the little finger of the golfer. Therefore, the wrist's role required in the swing action has not any impediment occurrence.

In the second embodiment, construction of the wrist fixing band for golf is as follow. The wrist fixing band G' for golf according to the preferred second embodiment of the present invention has the same constitution as the wrist fixing band G for golf according to the preferred first embodiment of the present invention, except that it has a particular construction for controlling the segment line L of the prop of the back of the arm 1 and the center pin 4. Accordingly, descriptions of constitutional elements which are identical to the constitutional elements of the wrist fixing band G for golf according to the preferred first embodiment of the present invention will be omitted. Further, inventive elements which are identical to the inventive elements used in the preferred first embodiment of the present invention have the same reference numerals.

Figure 6:
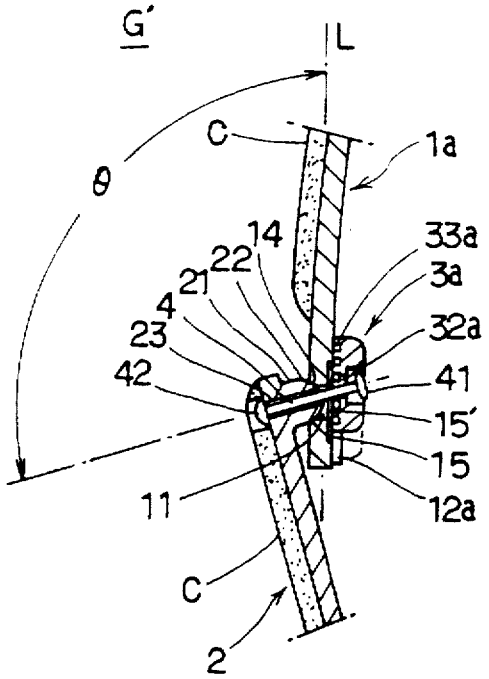
FIGS. 6 and 7 are enlarged sectional views taken along line I—I illustrated in FIG. 2, showing a preferred second embodiment according to the present invention.
Figure 7:
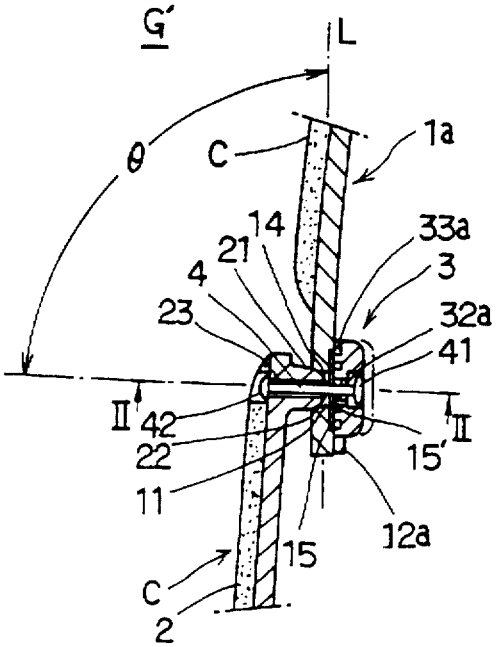
Figure 8:
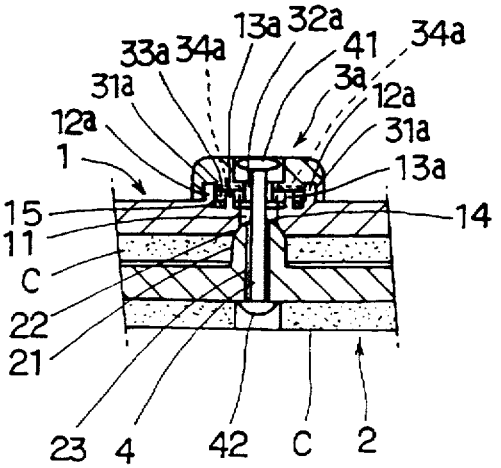
FIG. 8 is an enlarged sectional view taken along line II—II illustrated in FIG. 7.

FIGS. 6 and 7 is a schematic sectional view of the wrist fixing band G' for golf according to the present invention. The wrist fixing band G' for golf includes a prop of the back of the arm 1*a*, a prop of the back of the hand 2, a bending angle control knob 3*a*, a center pin 4 and a fixing member 5.

In the prop of the back of the arm 1*a*, a pair of guide protrusions 12*a* longitudinally extend from a surface of the prop of the back of the arm 1*a*. A center pin hole 11 is formed through a center of the prop of the back of the arm 1*a*. A stop protrusion 13*a* is formed between the guide protrusions 12*a*. A sliding surface 22 of a spacer 21 is inserted into a sliding groove 14 which is formed at a surface of the prop of the back of the arm 1*a*.

The bending angle control knob 3*a* is formed as a circular plate shape having a predetermined thickness, and includes sliding grooves 31*a* for receiving the guide protrusions 12*a* of the prob of the back of the arm 1. The bending angle control knob 3 includes a center pin hole 32*a* which is formed through a center of the bending angle control knob 3. A plurality of locking grooves 33*a* are formed at an outer periphery of a bottom side of the bending angle control knob 3*a*. A magnetic 34*a* is fixed to an inner side of the locking grooves 33*a*. Under the state that the guide protrusion 12*a* of the prop of the back of the arm 1*a*is inserted into the sliding groove 31*a*, a stop protrusion 13*a* protruding from an outer surface of the prop of the back of the arm 1*a* can be inserted into the locking groove 33*a*. The metal piece 15*a* is fixed to the outer surface of the prop of the back of the arm 1*a*and can be engaged with the magnetic 34*a*. The bending angle control knob 3*a* can rotate under the state that the bending angle control knob 3*a* is pulled upwards.

The center pin 4 is inserted into a first center pin hole 11*a* of the prop of the back of the arm 1*a*, a second pin hole 23*a* of the prop of the back of the hand 2 and a third center pin hole 32*a* of the bending angle control knob 3*a* in sequence. The center pin 4 has a predetermined length so that the stop protrusion 13*a* of the prop of the back of the arm 1*a* can be released from the locking groove 33*a* of the bending angle control knob 3*a* by pulling the bending angle control knob 3*a* upwards. Thereby, the bending angle control knob 3*a* can move toward the prop of the back of the arm 1*a*.

Therefore, if a golfer make move the bending angle control knob 3*a* in the longitudinal direction of the prop of the back of the arm 1*a* under the state that the bending angle control knob 3*a* is pulled upwards, both ends of the center pin 4 move in the opposite direction of the longitudinal direction of the prop of the back of the arm 1*a* centering around the center pin hole 23 of the prop of the back of the hand 2.

As shown in FIG. 6, if an angle θ established by a segment line L of the prop of the back of the arm 1*a* and the center pin 4 at the time that the bending angle control knob 3*a* rotates is maximized, the prop of the back of the hand 2 is bent toward the outer surface of the prop of the back of the arm 1*a*. As shown in FIG. 7, the angle θ established by a segment line L of the prop of the back of the arm 1*a* and the center pin 4 at the time that the bending angle control knob 3*a* rotates is minimized, the prop of the back of the hand 2 is bent toward the bottom side of the prop of the back of the arm 1*a*. When a certain angle is given between the prop of the back of the arm 1*a* and the prop of the back of the hand 2, the prop of the back of the hand 2 is bent toward the thumb and the little finger of the golfer centering around the center pin 4.

The fixing member 5 is engaged with the prop of the back of the arm 1*a*. The wrist fixing band G' for golf according to the preferred second embodiment of the present invention is put on the wrist of the golfer in the same manner as the wrist fixing band G for golf according to the preferred first embodiment of the present invention. The wrist fixing band G' for golf prevents the wrist of the golfer from bending toward the prop of the golfer's hand. If a golfer makes move the bending angle control knob 3*a* in the longitudinal direction of the prop of the back of the arm 1*a* under the state that the bending angle control knob 3*a* is pulled upwards, the golfer can control the relative bending angle between the prop of the back of the arm 1*a* and the prop of the back of the hand 2 by controlling the angle θ between the center pin 4 and the prop of the back of the arm 1*a*. Thereby, the relative bending angle of the prop of the back of the arm 1*a* and the prop of the back of the hand 2 can be controlled according to the golfer's preference.

Once controlled relative bending angle of the prop of the back of the hand 2 and the prop of the back of the arm 1*a*, removed the pulling force of the bending angle control knob 3*a*the stop protrusion 13*a* of the prop of the back of the arm 1*a* is inserted into the locking groove 33*a* of the bending angle control knob 3*a* by the magnetic force of the magnetic 34*a* fixed to the bottom side of the bending angle control knob 3*a*. Thereby, the movement of the bending angle control knob 3*a* is prevented during the swing action, and the bending angle between the prop of the back of the arm 1*a* and the prop of the back of the hand 2 is not changed. Even if the bending angle of the prop of the back of the arm 1*a* and the prop of the back of the hand 2 is maintained, the prop of the back of the hand 2 can be got movable in the direction of golfer's thumb and little finger. Therefore, the wrist's role required in the swing action has not any impediment occurrence.

In the preferred embodiments according to the present invention as described above, since the wrist of the golfer cannot bent toward the palm of the golfer during the swing action, it is unnecessary to have any device for preventing the wrist of the golfer from bending toward the palm of the golfer. Therefore, the golfer freely uses the wrist during the swing action. Reference numeral C is a cushion member which is fixed to the bottom side of the prop of the back of the arm 1*a* and the prop of the back of the hand 2.

As described above, if a golfer swings a golf club under the state that the golfer puts on the wrist fixing band according to the present invention, the center pin prevents the prop of the back of the hand from bending toward the outer surface or the bottom side of the prop of the back of the arm. Accordingly, the wrist of the golfer is not bent toward the back of the golfer's hand. Therefore, the prop of the back of the hand can be got movable in the direction of golfer's thumb and little finger. Consequently, if the golfer swings the golf club under the state that the golfer puts on the wrist fixing band according to the present invention, the golfer can fix the wrist of the golfer as a desired state for swing. In addition, If the golfer swings the golfer club for a desired time under the state that the golfer puts on the wrist fixing band according to the present invention, the wrist of the golfer can be trained a desired state for swing.

Further, the present invention includes a construction for controlling the bending of the prop of the back of the hand toward the outer surface or the bottom side of the prop of the back of the arm, and a construction for making move the prop of the back of the hand toward the golfer's thumb and little finger. Accordingly, the construction of the wrist fixing band is simple and the manufacturing cost of the wrist fixing band is low. More particularly, in the wrist fixing band for golf according to the preferred second embodiment of the present invention, although the golfer controls the bending angle between the center pin and the prop of the back of the arm, the center pin does not move toward the width of the prop of the back of the arm. Thereby, the relative bending angle between the prop of the back of the arm and the prop of the back of the hand is accurately controlled.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. A wrist fixing band for golf comprising:

a prop of the back of an arm being formed as a shape capable of supporting the back of the arm, said prop of the back of the arm including a first center pin hole which is formed through a front end of said prop of the back of the arm, said prop of the back of the arm including a guide protrusion protruding from an outer surface of said prop of the back of the arm, and said prop of the back of the arm including a first sliding groove which is formed through a lower portion of said prop of the back of the arm;

a prop of the back of the hand formed as a shape capable of supporting the back of the hand, said prop of the back of the hand including a spacer protruding from an outer surface of said prop of the back of the hand at a rear end thereof, said prop of the back of the hand including a second center pin hole which is formed through a center of said spacer, in which an upper portion of said spacer is inserted into said first sliding groove;

a bending angle control knob being formed as a circular plate having a predetermined thickness, said bending angle control knob including a second sliding groove for receiving said guide protrusion, said bending angle control knob including a second center pin hole which is formed through a center of said bending angle control knob, in which said second sliding groove is formed at a bottom side of said bending angle control knob, and said guide protrusion is inserted into said second sliding groove;

a center pin for fixing said prop of the back of the arm, said prop of the back of the hand and said bending angle control knob together, said center pin being inserted into said first, second and third center pin hole in sequence, said center pin having a head portion at its front end and a fixing portion at its rear end; and a fixing means for fixing said prop of the back of the arm to an arm of the golfer, whereby, a relative bending angle of said prop of the back of the arm and said prop of the back of the hand is controlled by controlling a slant direction of said center pin in accordance with the rotation of said bending angle control knob.

2. A wrist fixing band for golf as claimed in claim 1, wherein a plurality of locking grooves are formed at the bottom side of said bending angle control knob, a magnetic is fixed to an inner side of said locking grooves, a stop protrusion is formed at an outer surface of said prop of the back of the arm and is inserted into said locking grooves, a metal piece is fixed to the outer surface of said prop of the back of the arm and is engaged with said magnetic, said center pin has a predetermined length so that said stop protrusion can be released from said locking grooves of said bending angle control knob, and said bending angle control knob can rotate under the state that said bending angle control knob is pulled toward upwards.

3. A wrist fixing band for golf comprising:

a prop of the back of an arm being formed as a shape capable of supporting the back of the arm, said prop of the back of the arm including a first center pin hole which is formed through a front end of said prop of the back of the arm, said prop of the back of the arm including a pair of guide protrusions protruding from an outer surface of said prop of the back of the arm at both sides of said first center pin hole, and said prop of the back of the arm including a first sliding groove which is formed through a lower portion of said prop of the back of the arm;

a prop of the back of the hand formed as a shape capable of supporting the back of the hand, said prop of the back of the hand including a spacer protruding from an outer surface of said prop of the back of the hand at a rear end thereof, said prop of the back of the hand including a second center pin hole which is formed through a center of said spacer, in which an upper portion of said spacer is inserted into said first sliding groove;

a bending angle control knob being formed as a plate shape having a predetermined thickness, said bending angle control knob including second sliding grooves for receiving said guide protrusion, said bending angle control knob including a second center pin hole which is formed through a center of said bending angle control knob, in which said second sliding groove are formed at a bottom side of said bending angle control knob, and said guide protrusion are inserted into said second sliding grooves;

a center pin for fixing said prop of the back of the arm, said prop of the back of the hand and said bending angle control knob together, said center pin being inserted into said first, second and third center pin hole in sequence, said center pin having a head portion at its front end and a fixing portion at its rear end; and a fixing means for fixing said prop of the back of the arm to an arm of the golfer, whereby, a relative bending angle of said prop of the back of the arm and said prop of the back of the hand is controlled by controlling a bending angle between said prop of the back of the arm and said center pin in accordance with the movement of said the bending angle control knob.

4. A wrist fixing band for golf as claimed in claim 3, wherein a plurality of locking grooves are formed at the bottom side of said bending angle control knob, a magnetic is fixed to an inner side of said locking grooves, a stop protrusion is formed at an outer surface of said prop of the back of an arm and is inserted into said locking grooves, a metal piece is fixed to the outer surface of said prop of the back of an arm and is engaged with said magnetic, said center pin has a predetermined length so that said stop protrusion can be released from said locking grooves of said bending angle control knob, and said bending angle control knob can rotate under the state that said bending angle control knob is pulled toward upwards.

* * * * *